US007201540B2

(12) United States Patent
Ding

(10) Patent No.: US 7,201,540 B2
(45) Date of Patent: Apr. 10, 2007

(54) CONSTRUCTION PROCESS FOR COMPOSITE PILE FOUNDATION

(76) Inventor: Jinliang Ding, No. 21, Zongguang Road, Beijing (CN) 100037

( * ) Notice: Subject to any disclaimer, the term of this patent is extended or adjusted under 35 U.S.C. 154(b) by 0 days.

(21) Appl. No.: 11/272,556

(22) Filed: Nov. 10, 2005

(65) Prior Publication Data

US 2006/0147274 A1 Jul. 6, 2006

(51) Int. Cl.
*E02D 5/44* (2006.01)

(52) U.S. Cl. ..... 405/237; 405/243; 405/242; 405/233

(58) Field of Classification Search ..... 405/229, 405/231, 232, 233, 237, 238, 242, 243, 249, 405/255, 256, 277
See application file for complete search history.

(56) References Cited

U.S. PATENT DOCUMENTS

| | | | | |
|---|---|---|---|---|
| 1,764,948 | A * | 6/1930 | Frankignoul | 405/237 |
| 3,423,944 | A * | 1/1969 | Goodman | 405/237 |
| 3,568,452 | A * | 3/1971 | Stifler, Jr. | 405/237 |
| 3,960,008 | A * | 6/1976 | Goble et al. | 405/237 |
| 4,701,078 | A * | 10/1987 | Jse | 405/238 |

* cited by examiner

*Primary Examiner*—Frederick L. Lagman
(74) *Attorney, Agent, or Firm*—Tarolli, Sundheim, Covell & Tummino, LLP

(57) ABSTRACT

A construction process for the composite pile foundation which consists of the expanded belled base and the pile shaft, the construction process comprising the steps of: a) Aligning the pile tip at the pile location and place the casing at the top of the pile tip; b) Lifting the heavy hammer to enter the casing, repeatedly lift the heavy hammer to reach the given height and back press the casing, let it fall freely to ram the pile tip and the soil until a hole forms at the pile location; c) Lifting the heavy hammer higher than the feed inlet of the casing and fill solid material from the inlet into the casing; d) Ramming the above-mentioned solid material and repeat the filling and ramming operations; e) Controlling the penetration of the last three blows; f) Filling graded aggregate or stiff consistency concrete and repeatedly ram it to form the expanded belled base; g) pull out the casing; h) Aligning the pile shaft at the pile hole and repeatedly back press and blow slightly with the heavy hammer to drive the pile shaft into the pile bole and fix and connect it with the expanded belled base; i) Controlling the penetration of the last three bouts and form the pile. The invention offers the advantages of high bearing capacity, small settlement, short pile shaft, low engineering cost, simple construction, short construction period, easy quality control etc.

9 Claims, 4 Drawing Sheets

CONSTRUCTION PROCESS FOR COMPOSITE PILE FOUNDATION

FIELD OF THE INVENTION

The present invention relates to a pile foundation, and more particularly to the construction process for composite pile foundation used in building and structure pile foundation engineering.

BACKGROUND OF THE INVENTION

In the field of construction engineering, different pile configurations are available in pile foundation engineering. In these pile configurations, rammed compaction pile and diving casting cast-in-place-pile are currently two pile configurations in common use. The rammed compaction pile is constructed through the following steps: fill stiff consistency concrete into the bottom of the pile hole through the casing, blow the interior of the pile hole with heavy hammer to ram the stiff consistency concrete, repeat the filling and ramming operations, and re-pour concrete to form the concrete pile consisting of the expanded belled base and the pile shaft; the diving casting cast-in-place pile is constructed through the following steps: first sink the pile tip to reach the designed elevation, and pour the concrete for pile shaft use to form the pile. Although these two pile configurations have the advantages of higher bearing capacity and simple structure, it is difficult to control the quality of pile shaft and achieve ideal compaction effect of soil due to small diameter of stiff expanded belled base of rammed compaction pile, and big diameter and long pile shaft of diving casting cast-in-place pile. Therefore more advanced construction process and new pile configurations are needed in pile foundation engineering.

SUMMARY OF THE INVENTION

It is an object of the present invention to provide a construction process for composite pile foundation that has advantages of simple design, easy quality control, simple construction and short construction period to overcome problems in the art.

To achieve the abovementioned objective, the composite pile foundation of present invention consists of the expanded belled base and the pile shaft, and its construction process comprising the steps of:

a) Aligning the pile tip at the preset pile location and place the casing at the top of the pile tip;

b) Lifting the heavy hammer to enter the casing, repeatedly lift it to reach the given height and simultaneously back press the casing, let it fall freely to ram the pile tip and the soil until a hole forms at the pile location;

c) Lifting the heavy hammer higher than the feed inlet of the casing and fill solid material into the casing through the feed inlet;

d) Ramming the above-mentioned solid material and repeat the filling and ramming operations;

e) The input of the above-mentioned solid material is controlled according to the following designed elevation and the total penetration of three blows: measuring the penetration of three continuous blows on condition that no material is being filled, if the penetration per blow is less than or equal to the penetration of the previous blow and the requirement of the design specification is met, stop filling; otherwise, continue filling and ramming;

f) Filling graded aggregate or stiff consistency concrete, repeatedly ramming it to form the expanded belled base at the bottom of the pile hole;

g) Pulling out the casing;

h) Aligning the pile shaft at the pile hole and repeatedly back pressing and blowing slightly with the heavy hammer to drive it into the pile hole and fix and connect it with the expanded belled base;

i) Forming the composite pile foundation.

In the abovementioned process, it is preferred that the pile shaft and the expanded belled base are fixed and connected through embedding the pile shaft in the graded aggregate or stiff consistency concrete of the expanded belled base.

In the abovementioned process, it is preferred that the preset pile location is the pile location on the natural ground.

In the abovementioned process, it is preferred that the solid material is construction waste, or pebble, crushed stone etc.

In the abovementioned process, it is preferred that pre-cast pile shaft is used as the pile shaft and the construction steps include: lift the pre-cast pile shaft and align it at pile hole, apply hack pressure on the pile shaft and strike it slightly with the heavy hammer to force the pile shaft into the pile hole, and when the pile is driven close to the design elevation, measure the penetration of the last three bouts and ensure that the requirement of the construction acceptance specification is met.

In the abovementioned process, it is preferred that the pre-cast pile shaft with the bottom sealed or plugged by pouring the concrete as that for the pile bottom is used as the pile shaft.

In the abovementioned process, it is preferred that the pre-cast pile shaft with the bottom sealed by welding a steel plate is used as the pile shaft.

The advantages of present invention include higher bearing capacity of single pile and lower penetration of pile foundation due to forming of the effective composite bearing base at the pile bottom; simple construction, shortened construction period; dramatically reduced investment cost since the materials for the expanded belled base are mostly construction waste and natural solid materials.

BRIEF DESCRIPTION OF THE DRAWINGS

The above-mentioned and other features and objects of this invention will be better understood from the following detailed description taken in conjunction with the drawings wherein.

DETAILED DESCRIPTION OF THE INVENTION

Figures 1, 2:
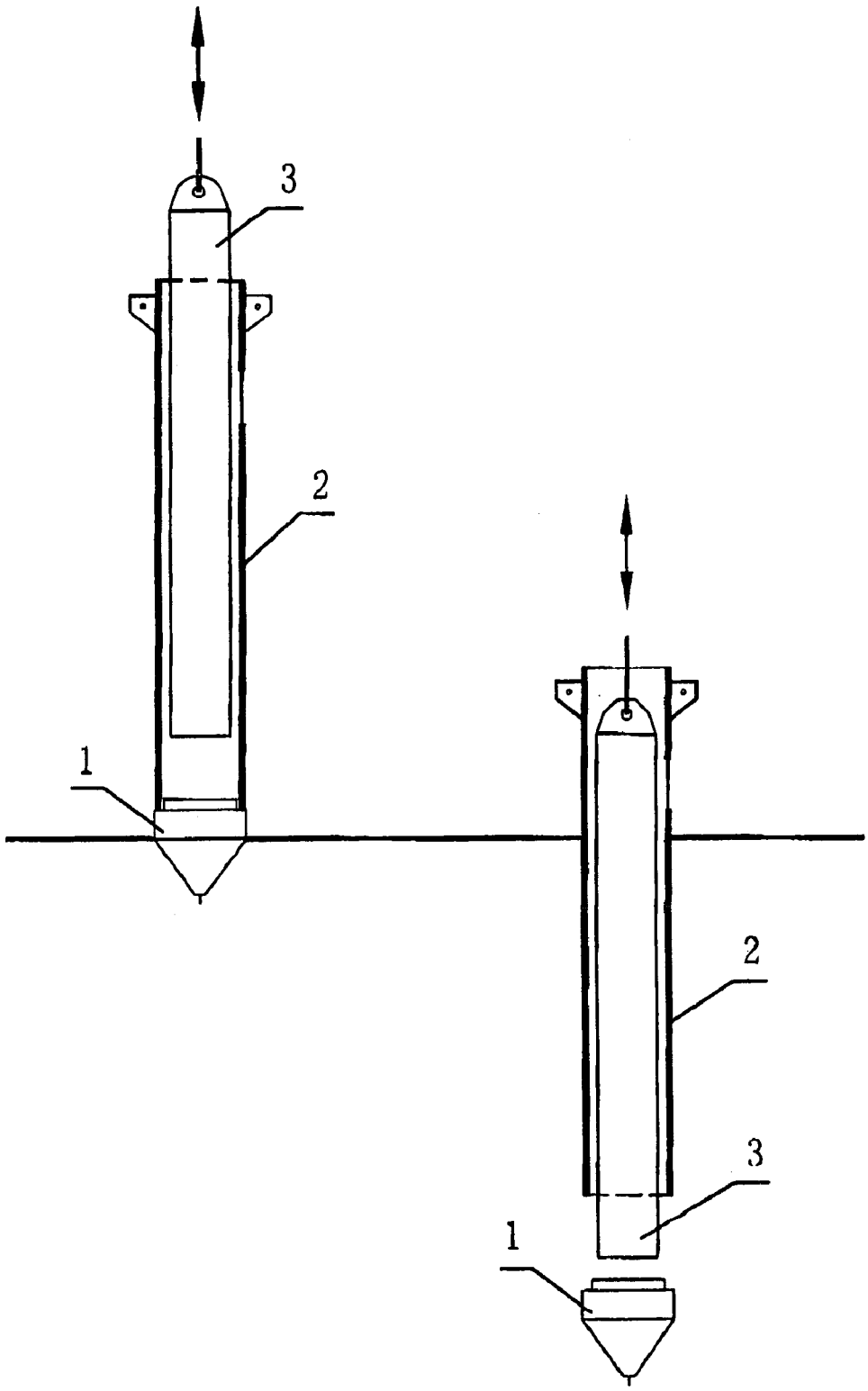
FIG. 1 illustrates a longitudinal section schematic view of pile location of composite pile foundation before hole forming in accordance with the present invention.
FIG. 2 illustrates a longitudinal section schematic view of the pile location as shown in FIG. 1 after hole forming.

FIG. 1 and FIG. 2 show the pile hole forming process of the composite pile foundation construction process in accordance with the present invention. When starting to construct, first align the pile tip 1 at the preset pile location on the natural ground, then place the casing 2 at the top of the pile tip, and lift the heavy hammer 3 to enter the casing 2 as shown in FIG. 1; repeatedly lift the heavy hammer and let it fall freely to form a hole at the pile location as shown in FIG. 2. Compared with the prior art pile configurations, the construction process of the present invention is to directly align the pile tip 1 at the preset pile location on the natural grounds place the casing 2 at the top of the pile tip 1, repeatedly lift the heavy hammer 3 and back press the casing 2 to sink it along the pile hole, this not only simplifies the operation steps, but also increases the construction quality of pile hole.

Figure 3:
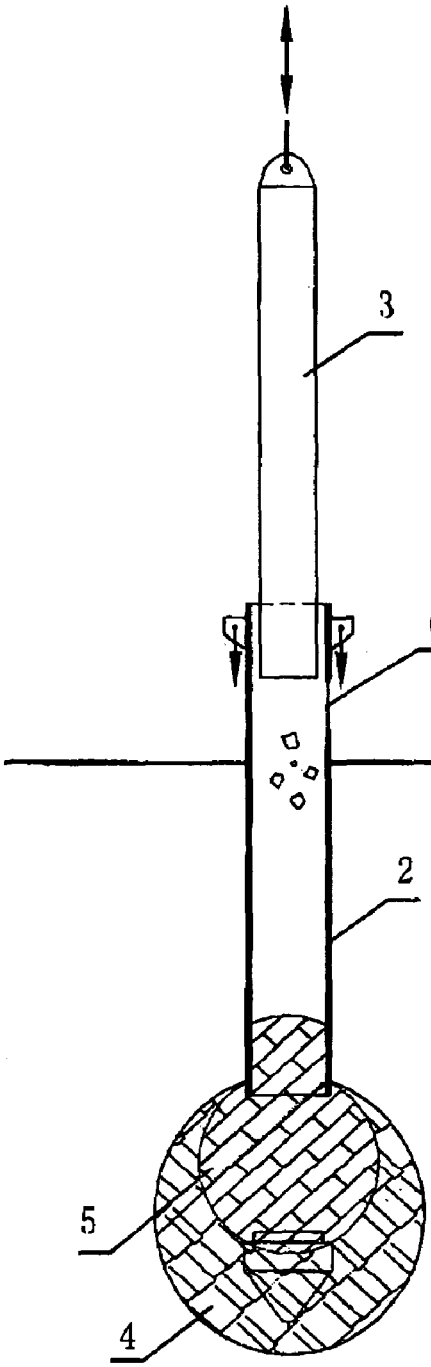
FIG. 3 illustrates a longitudinal section schematic view of filling solid material into the casing and ramming.
Figure 4:
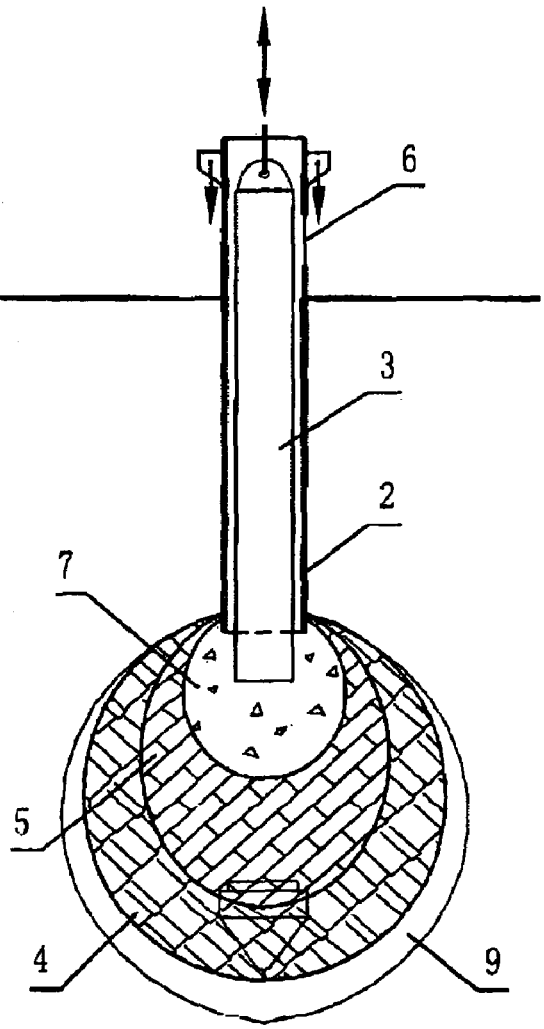
FIG. 4 illustrates a longitudinal section schematic view of filling and ramming graded aggregate or stiff consistency concrete.

FIG. 3 and FIG. 4 show tie forming process of the expanded belled base of the composite pile foundation in the construction process in accordance with the present invention. As shown in FIG. 3, after the pile hole has formed during construction, lift the heavy hammer 3 higher than the feed inlet 6 of the casing 2 and fill solid material 5 into the casing 2 through the feed inlet 6, ram the solid material 5, and repeat the filling and ramming operations. During this operation process, while the solid material is being constantly filled and rammed, the soil at the bottom of the pile hole increasingly expands outwards, and its volume gradually increases. In the meanwhile, the surrounding soil is constantly compacted, and the density of the soil gradually increases, so compacted soil 4 forms around the rammed solid material 5. The input of the abovementioned solid material 5 is controlled according to the total penetration of the following three blows, this requires to measure the penetration of three continuous blows on condition that no material is being filled, if the penetration per blow is less than or equal to the penetration of the previous blow, and the requirement of the design specification is met, stop filling; otherwise, continue filling and ramming. Construction waste, pebble or crushed stone can be used as the solid material 5. As shown in FIG. 4, after the input of solid material 5 meets the penetration requirement of the last three blows, fill graded aggregate or stiff consistency concrete 7 via the feed inlet 6 to the casing 2, and repeat the filling and ramming operations until the expanded belled base forms at the bottom of the pile hole. Thus it can seen, the expanded belled base that has formed consists of four parts with volume expanding gradually outwards, namely the rammed graded aggregate or stiff consistency concrete 7, rammed solid material 5, compacted soil 4, surrounding soil 9 of compacted soil 4. As the bearing base, it can diffuse the load and stress on the pile top to the bearing layer with larger bearing area downward. When bearing force, the bearing base expands the effective load-bearing volume of the soil in the bearing layer through deformation-coordination.

Figure 5:
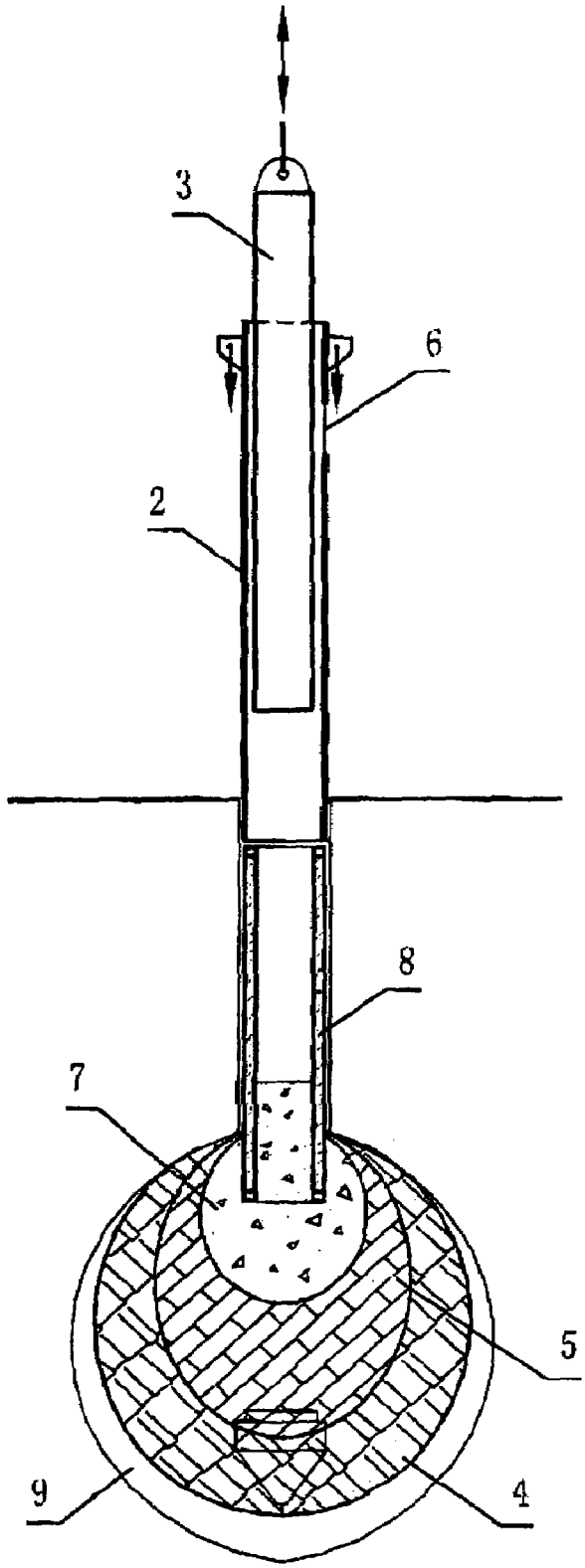
FIG. 5 illustrates a longitudinal section schematic view of embedding the pile shaft in the expanded belled base.

FIG. 5 shows the connecting process of the expanded belled base and the pile shaft 8. After the expanded belled has been constructed, pull out the casing 2, align the pre-cast pile shaft 8 at the pile hole, blow it slightly with the heavy hammer 3 and back press to drive it into the pile hole. When the pile is driven close to the design elevation, measures the penetration of the last three bouts (ten blows per bout), if the requirement of the construction acceptance specification is met, stop ramming. The pre-cast pile shaft 8 is embedded in the graded aggregate or the stiff consistency concrete 7 to realize the fixing and connection of the pile shaft 8 with the expanded belled base. The pre-cast pile shaft 8 with the bottom scaled or plugged by pouring the concrete with the same grade as that for the pile bottom, or the pre-cast pile shaft 8 with the bottom sealed by welding a steel plate is used as the pile shaft so as to increase the pressure-bearing area of the pile bottom and present solid material 7 on the expanded belled base from entering the pile shaft 8 during blowing with the heavy hammer 3 on the pile shaft to avoid affecting the embedding quality. A cross-shaped steel frame made of any shape steel such as flat steel, angle steel, steel bar etc., can be welded horizontally at the top of the pre-cast pile shaft 8 to facilitate the hoisting and connection of the pre-cast pile shaft 8.

The pile shaft 8 and the expanded belled base of the present invention can be fixed and connected on condition that the casing 2 has not been pulled out. This can be achieved through the following steps: after the expanded belled base has been constructed, lift the pre-cast pile shaft 8 to enter the casing 2 and blow it slightly with the heavy hammer 3. When the pile is driven close to the designed elevation, measures the penetration of the last three bouts (ten blows per bout), if the requirement of the construction acceptance specification is met, stop ramming. The pre-cast pile shaft is embedded in the graded aggregate or the stiff consistency concrete 7 to realize the fixing and connection of the pile shaft 8 with the expanded belled base. Pull out the casing 2, conduct pressure grouting at the gap between the pile hole and the pile shaft, exhaust air, pour fine-grained concrete, fill the gap and fix the pile shaft 8.

Cast-in-place pile shaft 8 can also be used as the pile shaft in the present invention, and is constructed through the following steps: after the expanded belled base has been constructed, first ram with the heavy hammer 3 to form the hole for rabbet connection, place the reinforcement cage into the casing 2 and enable the bottom of the cage to be embedded in the hole for rabbet connection, pour concrete into the casing 2 and simultaneously pull out the casing 2, stir and tamp the concrete that has been poured in to form the cast-in-place pile shaft 8.

Figure 6:
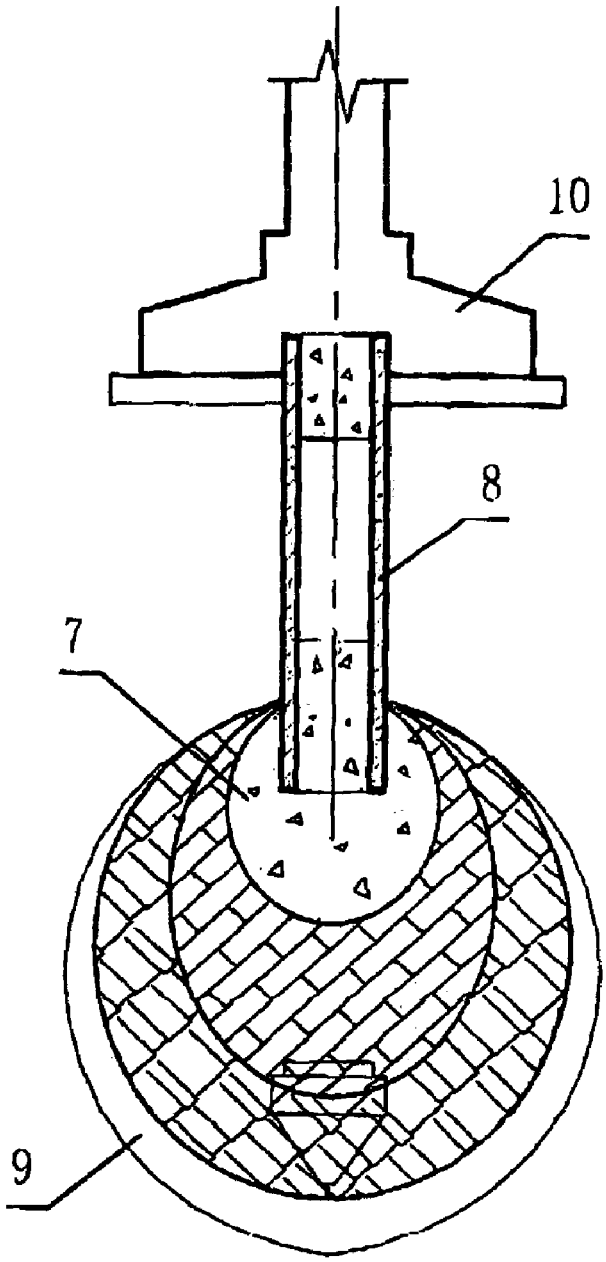
FIG. 6 illustrates a longitudinal section schematic view of pile forming for composite pile foundation in accordance with the present invention.

FIG. 6 shows the pile forming of the composite pile foundation of the present invention. After the pile shaft 8 is embedded in, the expanded belled base, expand the area of concrete grouting at the top of the pile shaft 8, and grout concrete to form the pile cap 10, to resist the effect of horizontal load. The finished pile has now been constructed.

In actual construction, based on the design requirements, the finished pile of the composite pile foundation of the present invention can consist of a pile cap 10 under which there are multiple composite pile foundations.

Compared with the prior art pile configurations, the composite pile foundation construction process of the present invention has lower requirement for the bearing layer, but requires the processing depth to be less than 24 meters.

The present invention features it attaches importance to changing the traditional function relation between the pile bottom and the groundwork soil rather than the pile body itself. The lumpy construction waste and graded aggregate or stiff consistency concrete is filled successively as the compacted soil 4 between the pile bottom and the bearing layer to form a large enough load diffuser. The load at the top is transmitted through the pile shaft 8 and the stress diffuse to the entire expanded belled base, fully improving the intensity of the soil under the pile bottom. The construction process for the composite pile foundation in accordance with the present invention adopts four construction quality control indexes, namely control of the designed elevation, control of the input of solid material, control of the penetration of the last three blows and control of the penetration of the last three bouts of pile shaft, to achieve the objective of shortening effective pile length, increasing bearing capacity of single pile, reducing settlement of pile foundation, shortening construction period and reducing engineering cost.

While in the foregoing specification the present invention has been described in relation to certain preferred embodiments thereof, and many details have been set forth for purposes of illustration, it will be apparent to those skilled in the art that the construction process for composite pile foundation is susceptible to additional embodiments and that certain of the details described herein can be varied considerably without departing from the basic principles of the invention.

What is claimed is:

1. A construction process for a composite pile foundation which consists of an expanded belled base and a pile shaft, the construction process comprising the steps of:

a) Aligning a pile tip at a preset pile location and place a casing at the top of the pile tip;

b) Lifting a heavy hammer to enter the casing, repeatedly lift it to reach a given height and simultaneously back press the casing, let it fall freely to ram the pile tip and the soil until a hole forms at the pile location;

c) Lifting a heavy hammer higher than a feed inlet of the casing and fill solid material into the casing through the feed inlet;

d) Ramming the above-mentioned solid material and repeat the filling and ramming operations;

e) The input of the above-mentioned solid material is controlled according to the following designed elevation and the total penetration of three blows: measuring the penetration of three continuous blows on condition that no material is being filled, if the penetration per blow is less than or equal to the penetration of the previous blow and the requirement of the design specification is met, stop filling; otherwise, continue filling and ramming;

f) Filling graded aggregate or stiff consistency concrete, repeatedly ramming it to form the expanded belled base at the bottom of the pile hole;

g) Pulling out the casing;

h) Aligning the pile shaft at the pile hole and repeatedly back pressing and blowing slightly with the heavy hammer to drive it into the pile hole and fix and connect it with the expanded belled base;

i) Forming the composite pile foundation.

2. The construction process of claim 1 wherein the pile shaft and the expanded belled base are fixed and connected through embedding the pile shaft in the graded aggregate or stiff consistency concrete of the expanded belled base.

3. The construction process of claim 1 wherein the preset pile location is the pile location on the natural ground.

4. The construction process of claim 1 wherein the solid material is construction waste, or pebble, crushed stone.

5. The construction process of claim 1 wherein pre-cast pile shaft is used as the pile shaft and the construction steps include: lift the precast pile shaft and align it at pile hole, apply back pressure on the pile shaft and strike it slightly with the heavy hammer to force the pile shaft into the pile hole, and when the pile is driven close to the design elevation, measure the penetration of the last three bouts and ensure that the requirement of the construction acceptance specification is met.

6. The construction process of claim 5 wherein the precast pile shaft with the bottom sealed or plugged by pouring the concrete as that for the pile bottom is used as the pile shaft.

7. The construction process of claim 5 wherein the precast pile shaft with the bottom sealed by welding a steel plate is used as the pile shaft.

8. The construction process of claim 5 wherein a crossshaped steel frame made of any shape steel is horizontally welded at the top of the pre-cast pile shaft.

9. A construction process for a composite pile foundation which includes an expanded belled base and a pile shaft, the construction process comprising the steps of:

a) Aligning a pile tip at a preset pile location and placing a casing at the top of the pile tip;

b) Lifting a hammer into the casing, repeatedly lifting said hammer to a given height and letting it fall freely to ram the pile tip until a hole forms at the pile location;

c) Concurrently back pressing the casing d) Lifting said hammer higher than a feed inlet of the casing and filling solid material into the casing through the feed inlet;

e) Ramming the abovementioned solid material;

f) Repeating steps e) and f);

g) The filling of solid material into the casing being controlled as follows:

i) measuring the penetration of three continuous blows on condition that no material is being filled;

ii) if the penetration per blow is less than or equal to the penetration of the previous blow and a design specification is met, stop filling; otherwise, continue with steps e) and f);

h) Filling graded aggregate or stiff consistency concrete into said casing and repeatedly ramming it to form the expanded belled base at the bottom of the pile hole;

i) Pulling out the casing; and, j) Aligning the pile shaft at the pile hole and repeatedly back pressing and striking said pile shaft with said hammer to drive said pile shaft into the pile hole and connecting it with the expanded belled base whereby said composite pile foundation is formed.

* * * * *

UNITED STATES PATENT AND TRADEMARK OFFICE

CERTIFICATE OF CORRECTION

PATENT NO. : 7,201,540 B2
APPLICATION NO. : 11/272556
DATED : April 10, 2007
INVENTOR(S) : Jinliang Ding It is certified that error appears in the above-identified patent and that said Letters Patent is hereby corrected as shown below:

Cover page, Insert --(30) Foreign Application Priority Data

Nov. 12, 2004 (CN) ..... 200410090681.1--

Signed and Sealed this

Thirtieth Day of December, 2008

JON W. DUDAS
*Director of the United States Patent and Trademark Office*